US008313000B1

(12) United States Patent
Tuan

(10) Patent No.: US 8,313,000 B1
(45) Date of Patent: Nov. 20, 2012

(54) FOLDABLE POT

(76) Inventor: Ronald Tuan, Nantou (TW)

( * ) Notice: Subject to any disclaimer, the term of this patent is extended or adjusted under 35 U.S.C. 154(b) by 0 days.

(21) Appl. No.: 13/305,170

(22) Filed: Nov. 28, 2011

(51) Int. Cl.
*B65D 6/16* (2006.01)

(52) U.S. Cl. ..... 220/6; 220/666; 220/573.1; 220/768

(58) Field of Classification Search ..... 220/6, 666, 220/753, 755, 758, 768, 912, 769, 759
See application file for complete search history.

(56) References Cited

U.S. PATENT DOCUMENTS

| | | | | |
|---|---|---|---|---|
| 3,301,293 | A * | 1/1967 | Santelli | 220/666 |
| 6,450,363 | B1 * | 9/2002 | Lin | 220/758 |
| 7,581,770 | B2 * | 9/2009 | Jones | 294/31.2 |
| 7,654,402 | B2 * | 2/2010 | Kusuma et al. | 220/8 |
| 2002/0134789 | A1 * | 9/2002 | Lin | 220/758 |
| 2010/0140279 | A1 * | 6/2010 | Tyson et al. | 220/666 |

* cited by examiner

*Primary Examiner* — Steven A. Reynolds
*Assistant Examiner* — King M Chu
(74) *Attorney, Agent, or Firm* — C. G. Mersereau; Nikolai & Mersereau, P.A.

(57) ABSTRACT

A foldable pot has a base, a folding body, two supporting shafts and two handles. The base is a metal basin and has a locking groove formed around an opening top of the base. The folding body is mounted on the opening top of the base and has a connecting ring, a folding segment and a mouth. The connecting ring is mounted in the locking groove and has a linking section. The folding segment is formed on and protrudes from the linking section and has two folding rings and a connecting section. The mouth is formed on the folding segment and has two pairs of through holes. The supporting shafts are transversely mounted in the mouth at intervals and each supporting shaft has two connecting arms. The handles are detachably connected to the connecting arms of the supporting shafts beside the folding body and each handle has an inserting hole.

9 Claims, 7 Drawing Sheets

FOLDABLE POT

BACKGROUND OF THE INVENTION

1. Field of the Invention

The present invention relates to a foldable pot, and more particularly to a foldable pot that can be folded to reduce the volume of the foldable pot and can be carried conveniently.

2. Description of Related Art

A conventional pot is used to store liquid such as water or drink and usually has a base, a body, a mouth and two handles. The body is formed on and protrudes form the base. The mouth is formed on the body opposite to the base and has an external surface. The handles are securely mounted on and protrude from the external surface of the mouth. Then, users can carry the conventional pot with the handles.

However, the base, the body and mouth of the conventional pot have a fixed structure and cannot be folded to reduce the volume of the conventional pot and this requires larger space to store the conventional pot when the conventional pot is not in use and the fixed structure of the conventional pot is inconvenient for carriage. Furthermore, the handles of the conventional pot are securely mounted on the external surface of the mouth, and cannot be folded and detached from the conventional pot and this is inconvenient in maintenance and cleanness.

To overcome the shortcomings, the present invention provides a foldable pot to mitigate or obviate the aforementioned problems.

SUMMARY OF THE INVENTION

The main objective of the present invention is to provide a foldable pot that can be folded to reduce the volume of the foldable pot and can be carried conveniently.

The foldable pot in accordance with the present invention has a base, a folding body, two supporting shafts and two handles. The base is a metal basin and has a locking groove formed around an opening top of the base. The folding body is mounted on the opening top of the base and has a connecting ring, a folding segment and a mouth. The connecting ring is mounted in the locking groove and has a linking section. The folding segment is formed on and protrudes from the linking section and has two folding rings and a connecting section. The mouth is formed on the folding segment and has two pairs of through holes. The supporting shafts are transversely mounted in the mouth at intervals and each supporting shaft has two connecting arms. The handles are detachably connected to the connecting arms of the supporting shafts beside the folding body and each handle has an inserting hole.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
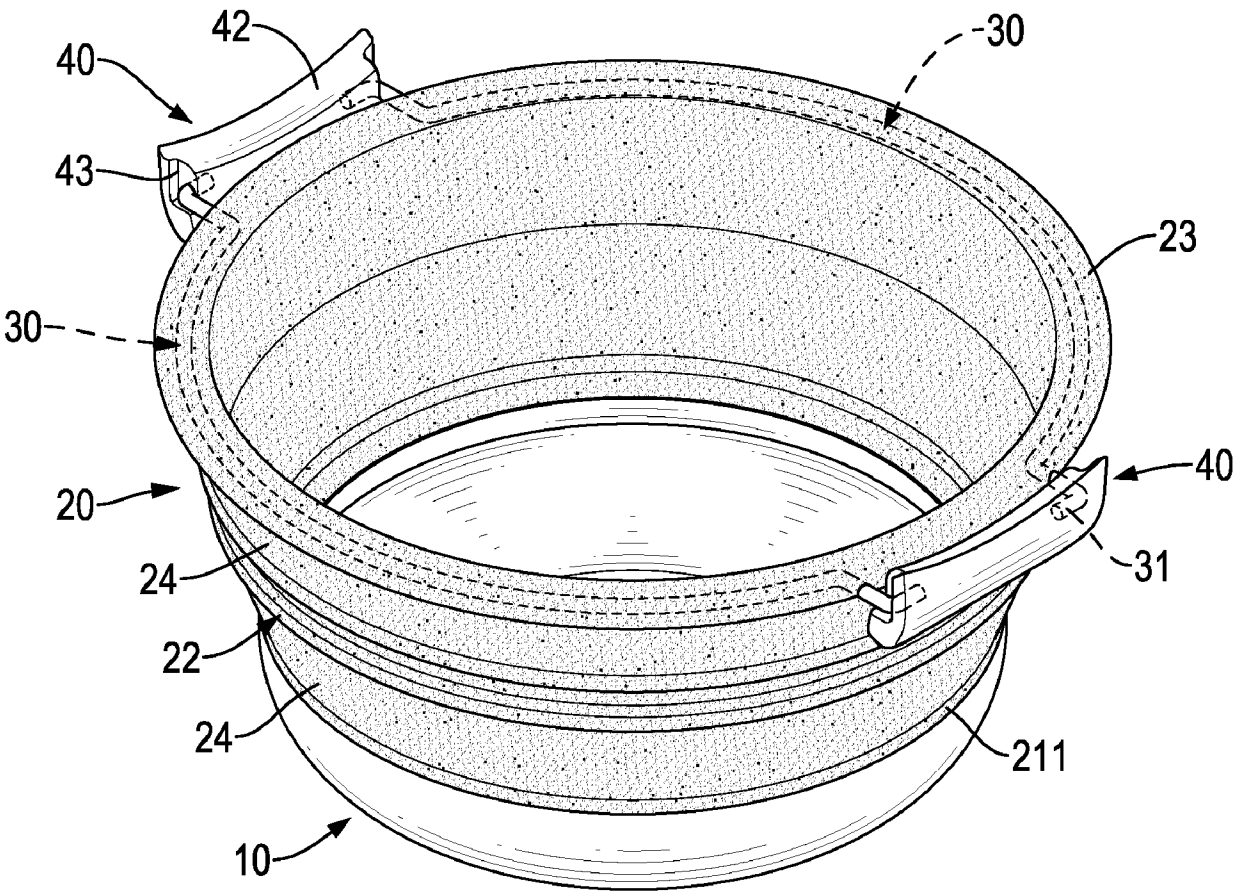
FIG. 1 is a perspective view of a foldable pot in accordance with the present invention.
Figure 2:
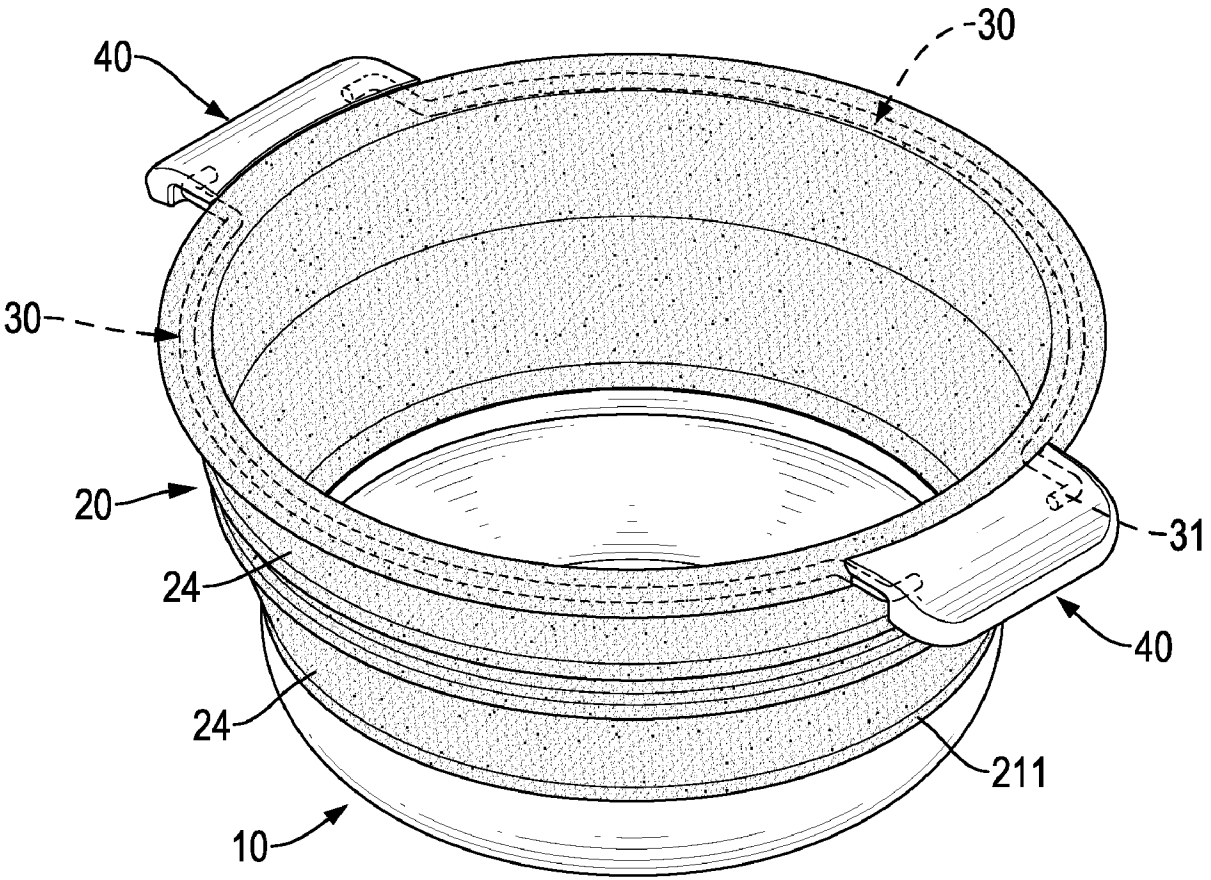
FIG. 2 is another perspective view of a foldable pot in accordance with the present invention.
Figure 3:
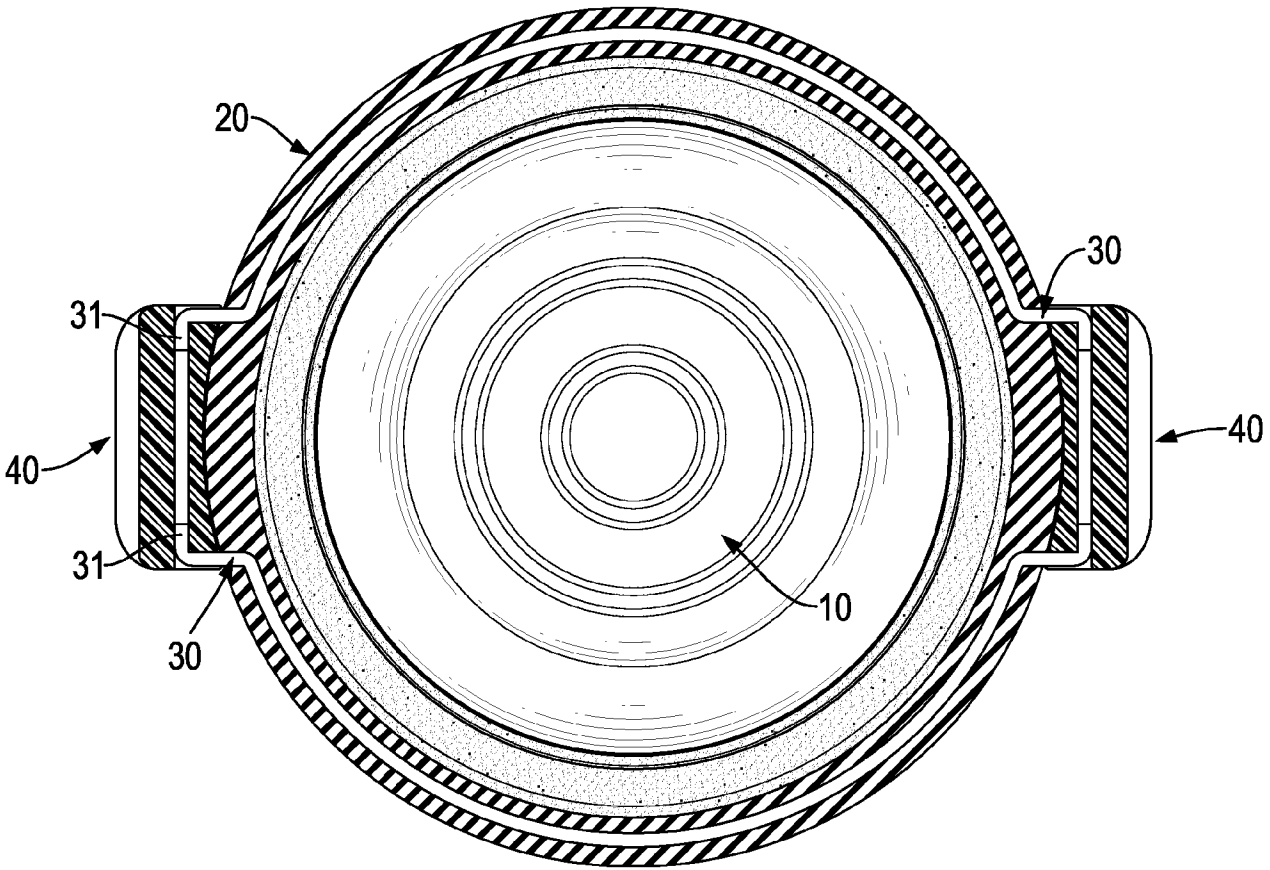
FIG. 3 is a top view in partial section of the foldable pot in FIG. 1.

With reference to FIGS. 1 to 3, 4A and 4B, a foldable pot in accordance with the present invention has a base 10, a folding body 20, two supporting shafts 30 and two handles 40.

The base 10 is a metal basin and has an opening top and a locking groove 11. The locking groove 11 is annularly formed around the opening top of the base 10.

The folding body 20 is made of silica gel by injection molding, is mounted on the opening top of the base 10 and has an interior, a connecting ring 21, a folding segment 22 and a mouth 23. The interior of the folding body 20 communicates with the opening top of the base 10.

Figure 4A:
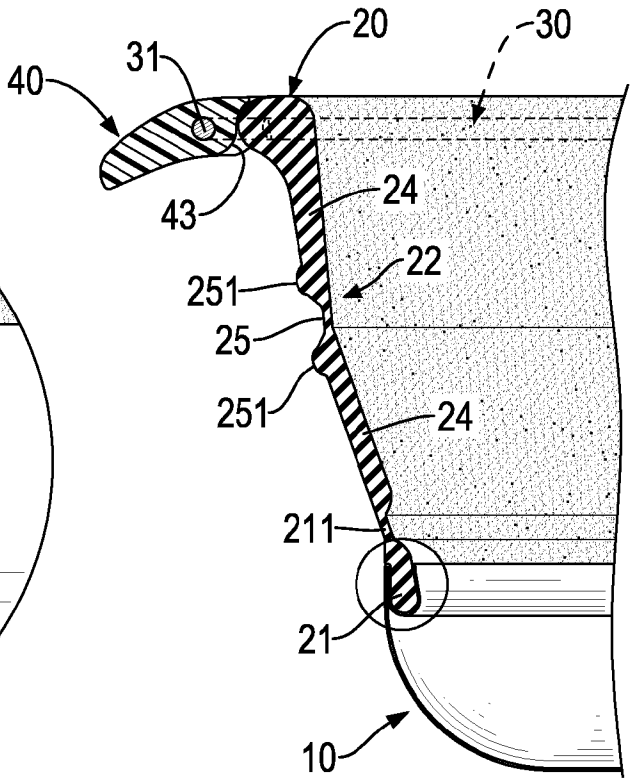
FIG. 4A is an enlarged cross sectional side view of the foldable pot in FIG. 1.
Figure 4B:
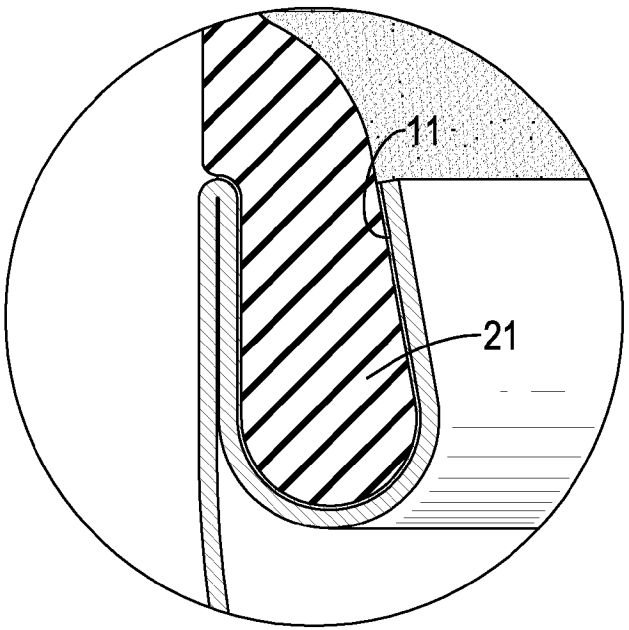
FIG. 4B is an enlarged cross sectional side view of the foldable pot in FIG. 4A.

With reference to FIGS. 4A and 4B, the connecting ring 21 is annular, is mounted in and adhered to the locking groove 11 of the base 10 and has a bottom, a top, a thickness and a linking section 211. The bottom of the connecting ring 21 is mounted in the locking groove 11 of the base 10. The top of the connecting ring 21 extends out of the locking groove 11 of the base 10. The linking section 211 is formed on the top of the connecting ring 21 and has a thickness smaller than the thickness of the connecting ring 21.

The folding segment 22 is formed on and protrudes from the linking section 211 of the connecting ring 21 and has two folding rings 24 and a connecting section 25. The folding rings 24 are continuously formed on the connecting ring 21 and each folding ring 24 is annular and has a bottom, a top and a thickness. The bottom of each folding ring 24 has a diameter and the bottom of the lowermost folding ring 24 is formed on the linking section 211 of the connecting ring 21. The top of each folding ring 24 has a diameter larger than the diameter of the bottom of the corresponding folding ring 24. The connecting section 25 is formed on the folding segment 22 between the folding rings 24 and has a thickness, a bottom, a top, an external surface and two protruding segments 251. The thickness of the connecting section 25 is smaller than the thickness of each one of the folding rings 24. The protruding segments 251 are respectively formed on and protrude from the external surface of the connecting section 25 near the top and the bottom of the connecting section 25.

Figure 6:
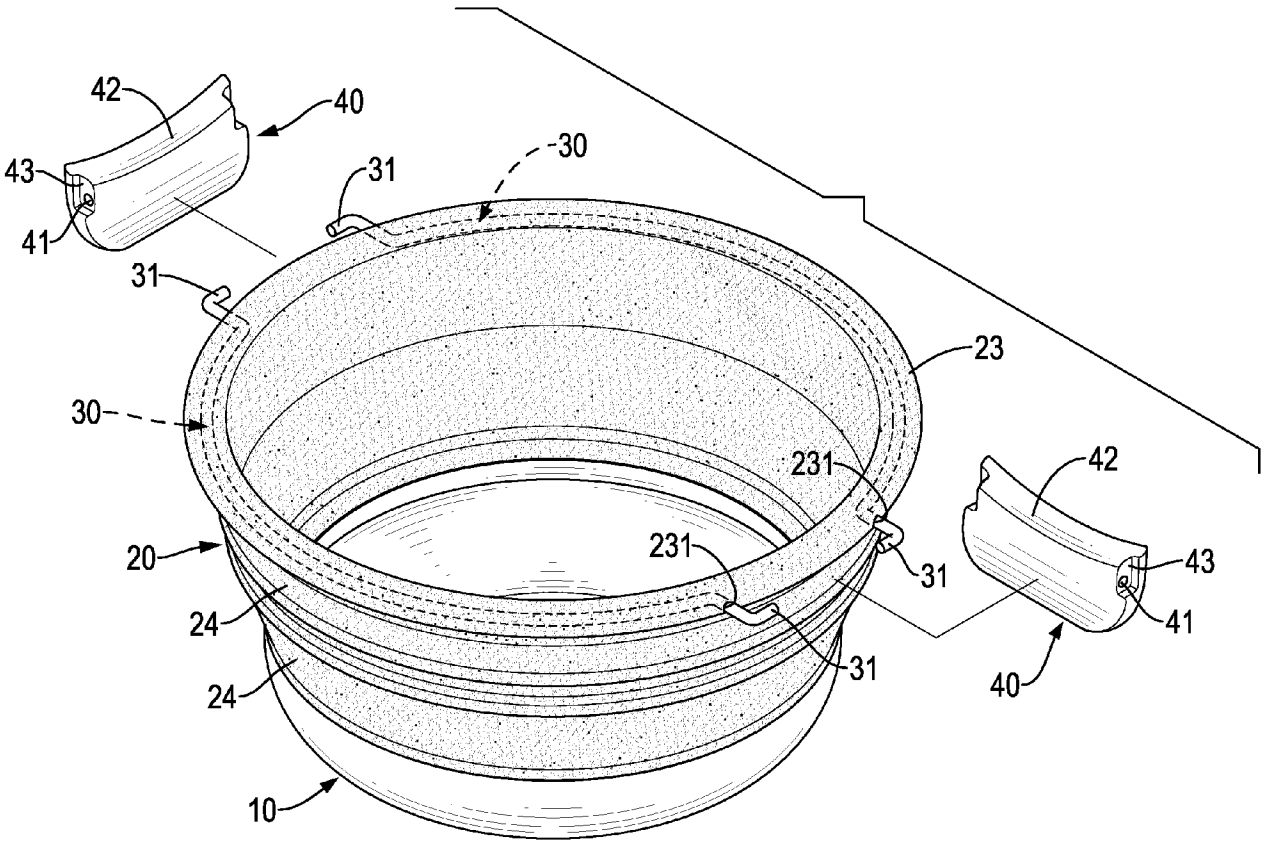
FIG. 6 is an exploded perspective view of the foldable pot in FIG. 1.

With further reference to FIG. 6, the mouth 23 is formed on the folding segment 22 and has a bottom, an opening top, an external surface and two pairs of through holes 231. The bottom of the mouth 23 is formed on the top of the uppermost folding ring 24. The opening top of the mouth 23 is formed on and protrudes from the bottom of the mouth 23, communicates with the opening top of the base 10 and has a shape. Each pair of through holes 231 is formed through the external surface of the mouth 23.

The supporting shafts 30 are semicircular, are transversely mounted in the mouth 23 of the folding body 20 at intervals to hold the shape of the opening top of the mouth 23 and each supporting shaft 30 has two ends and two connecting arms 31. The connecting arms 31 of each supporting arm 30 are respectively formed on the ends of the corresponding supporting shaft 30 and respectively extend out of the external surface of the mouth 23 via two of the pairs of through holes 231. Then, one of the connecting arms 31 of one of the supporting shafts 30 faces one of the connecting arms 31 of the other supporting shaft 30.

The handles 40 are detachably connected to the connecting arms 31 of the supporting shafts 30 beside the folding body 20 and each handle 40 has two opposite sides, an inner side, an inserting hole 41, a curved face 42 and two recesses 43. The inserting hole 41 is transversally formed through the opposite sides of the handle 40 and is mounted around one of the connecting arms 31 of one of the supporting shafts 30 and one of the connecting arms 31 of the other supporting shaft 30. The curved face 42 is formed on the inner side of the handle 40 and has a shape corresponding to the shape of the mouth 23 of the folding body 20. The recesses 43 are formed in the curved face 42 respectively at the opposite sides of the handle 40 and communicate with the inserting hole 41. Then, one of the connecting arms 31 of each supporting shaft 30 can abut the handle 40 in one of the recesses 43 of the corresponding handle 40 to enable the curved faces 42 of the handles 40 to move close to the external surface of the mouth 23.

With reference to FIGS. 1 and 4A, in use, the interior between the base 10 and the folding body 20 can be used to store liquid and the metal base 10 can be set on a heat source to heat the liquid in the folding body 20 of the foldable pot. After heating the liquid, a user can pivot the handles 40 to abut against the connecting arms 31 of the supporting shafts 30 to carry the foldable pot.

Figure 5:
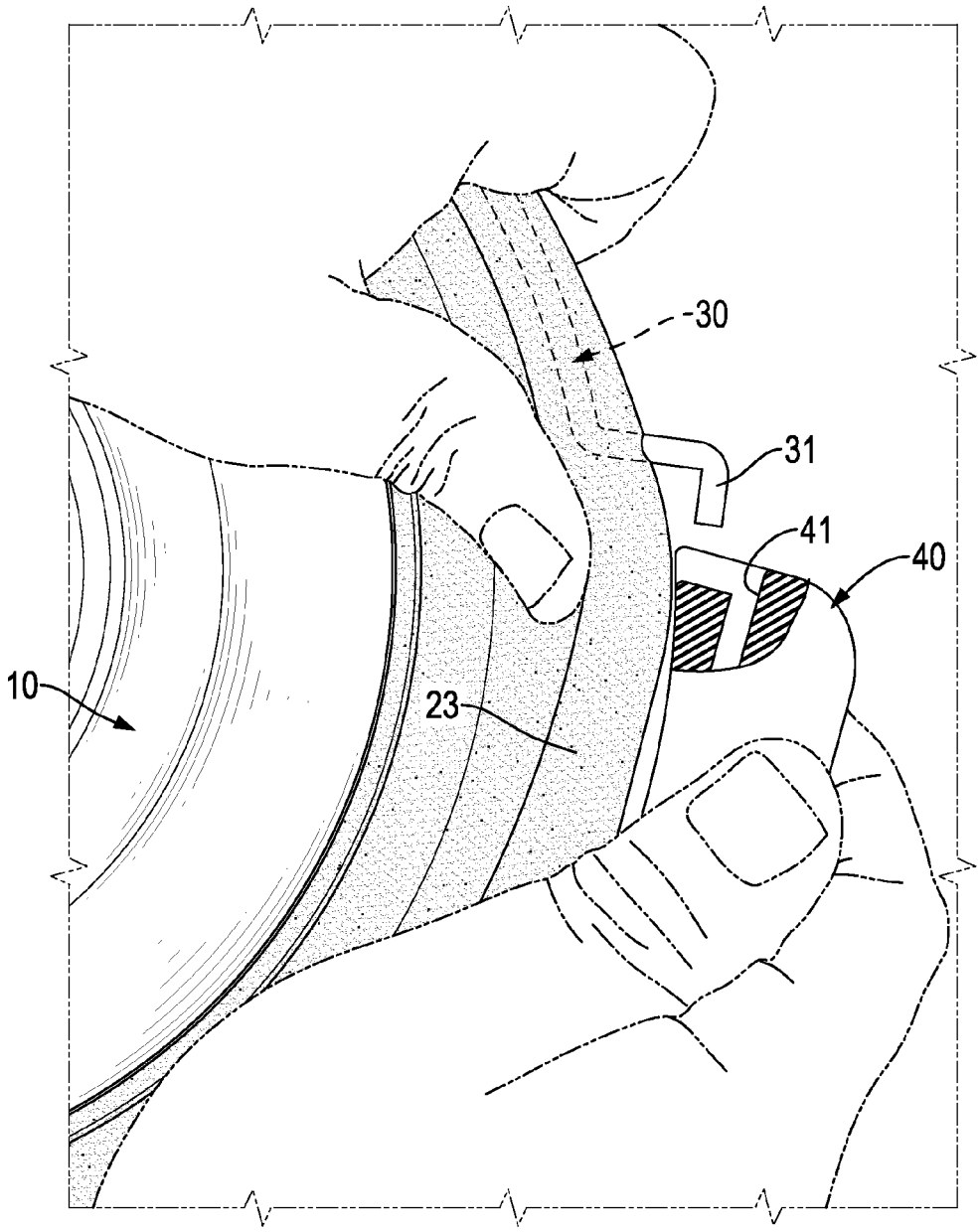
FIG. 5 is an enlarged operational top view in partial section of the foldable pot in FIG. 1 showing one of the handles of the foldable pot being detached.

In addition, with reference to FIG. 5, when the user wants to clean the foldable pot after using or to replace the handles 40, because the supporting shafts 30 are mounted in the mouth 23 at intervals and the folding body 20 is made of silica gel, the mouth 23 can be deformed at the intervals by a pushing force and this can enable the connecting arms 31 to be separated from the inserting hole 41 of the corresponding handles 40. Then, the handles 40 can be detached from the supporting shafts 30 as shown in FIG. 6 to clean, to maintain or to replace.

Figure 7:
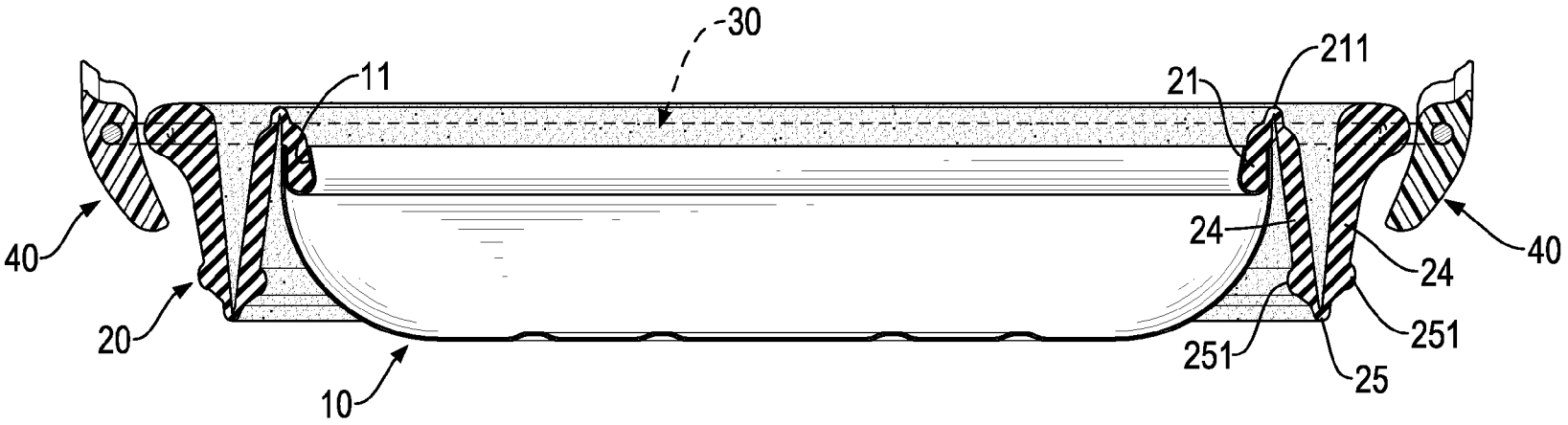
FIG. 7 is an operational cross sectional side view of the foldable pot in FIG. 1.

With reference to FIG. 7, when the foldable pot in accordance with the present invention needs to be folded to transport, carry or store, the user can press the mouth 23 downward to fold the folding rings 24 of the folding segment 22. Then, the folding rings 24 and the mouth 23 can be folded around the base 10 to reduce the volume of the foldable pot. In addition, the handles 40 can be pivoted relative to the connecting arms 31 of the supporting shafts 30 to move close the folding body 20 to further reduce the volume of the foldable pot.

According to the above-mentioned statements, the foldable pot in accordance with the present invention can be folded to reduce the volume and the height of the foldable pot by mounting the folding body 20 on the base 10. Furthermore, the supporting shafts 30 are mounted in the mouth 23 of the folding body 20 at intervals to hold the shape of the opening top of the mouth 23, and the mouth 23 can be deformed at the intervals to enable the handles 40 to separate from the connecting arms 31 of the supporting shafts 30 to clean, to maintain or to replace conveniently.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A foldable pot having a base being a metal basin and having an opening top; and a locking groove annularly formed around the opening top of the base;

a folding body mounted on the opening top of the base and having an interior communicating with the opening top of the base;

a connecting ring mounted in the locking groove of the base and having a bottom mounted in the locking groove of the base;

a top extending out of the locking groove of the base;

a thickness; and a linking section formed on the top of the connecting ring and having a thickness smaller than the thickness of the connecting ring;

a folding segment formed on and protruding from the linking section of the connecting ring and having two folding rings continuously formed on the connecting ring and each folding ring being annular and having a bottom having diameter and the bottom of the lowermost folding ring formed on the linking section of the connecting ring;

a top having a diameter larger than the diameter of the bottom of the corresponding folding ring; and a thickness; and a connecting section formed on the folding segment between the folding rings and having a thickness smaller than the thickness of each one of the folding rings; and a mouth formed on the folding segment and having a bottom formed on the top of the uppermost folding ring;

an opening top formed on and protruding from the bottom of the mouth, communicating with the opening top of the base and having a shape;

an external surface; and two pairs of through holes, each pair of through holes formed through the external surface of the mouth;

two supporting shafts transversely mounted in the mouth of the folding body at intervals to hold the shape of the opening top of the mouth and each supporting shaft having two ends; and two connecting arms respectively formed on the ends of the supporting shaft and respectively extending out of the external surface of the mouth via two of the pairs of through holes to enable one of the connecting arms of one of the supporting shafts to face one of the connecting arms of the other supporting shaft; and two handles detachably connected to the connecting arms of the supporting shafts beside the folding body and each handle having two opposite sides; and an inserting hole transversally formed through the opposite sides of the handle and mounted around one of the connecting arms of one of the supporting shafts and one of the connecting arms of the other supporting shaft.

2. The foldable pot as claimed in claim 1, wherein the connecting section has a bottom formed on the top of a lowermost folding ring of the two folding rings;

a top formed on the bottom of an uppermost folding ring of the two folding rings;

an external surface; and two protruding segments respectively formed on and protruding from the external surface of the connecting section near the top and the bottom of the connecting section.

3. The foldable pot as claimed in claim 2, wherein each handle has an inner side;

a curved face formed on the inner side of the handle and having a shape corresponding to the shape of the mouth of the folding body; and two recesses formed in the curved face respectively at the opposite sides of the handle, communicating with the inserting hole to enable the one of the connecting arms of each supporting shaft to abut the handle in one of the recesses of the corresponding handle and to enable the curved faces of the handles to move close to the external surface of the mouth.

4. The foldable pot as claimed in claim 3, wherein the bottom of the connecting ring is adhered to the locking groove of the base.

5. The foldable pot as claimed in claim 4, wherein the folding body is made of silica gel by injection molding.

6. The foldable pot as claimed in claim 5, wherein the connecting ring is annular and each supporting shaft is semicircular.

7. The foldable pot as claimed in claim 1, wherein the bottom of the connecting ring is adhered to the locking groove of the base.

8. The foldable pot as claimed in claim 1, wherein the folding body is made of silica gel by injection molding.

9. The foldable pot as claimed in claim 1, wherein the connecting ring is annular and each supporting shaft is semicircular.

* * * * *